United States Patent [19]

Masaka et al.

[11] Patent Number: 4,939,347

[45] Date of Patent: Jul. 3, 1990

[54] ENERGIZATION CONTROL APPARATUS FOR GLOW PLUG

[75] Inventors: Mitusuke Masaka; Koji Hatanaka; Minoru Masaki; Takashi Aota, all of Saitama, Japan

[73] Assignee: Jidosha Kiki Co., Ltd., Tokyo, Japan

[21] Appl. No.: 285,762

[22] Filed: Dec. 16, 1988

[30] Foreign Application Priority Data

Dec. 17, 1987 [JP] Japan ..... 62-317572
Feb. 17, 1988 [JP] Japan ..... 63-32853
May 12, 1988 [JP] Japan ..... 63-113481

[51] Int. Cl.[5] ..... H05B 1/02

[52] U.S. Cl. ..... 219/492; 219/202; 219/205; 219/501; 219/506; 123/179 H; 123/179 BG

[58] Field of Search ..... 219/201-203, 219/491, 494, 205, 497, 499, 501, 506, 507, 509, 492; 123/179 B, 179 H, 179 BG

[56] References Cited

U.S. PATENT DOCUMENTS 4,594,974 6/1986 Nowak ..... 219/492
4,594,975 6/1986 Shigenbu ..... 123/179 H
4,669,430 6/1987 Reinold et al. ..... 123/179 H
4,681,070 7/1987 Kurihara et al. ..... 123/179 H
4,742,209 5/1988 Minegishi et al. ..... 219/270
4,821,690 4/1989 Masaki ..... 219/497

FOREIGN PATENT DOCUMENTS 59-122782 7/1984 Japan .
59-231176 12/1984 Japan .
60-34786 10/1985 Japan .

*Primary Examiner*—M. H. Paschall
*Attorney, Agent, or Firm*—Blakely, Sokoloff, Taylor & Zafman

[57] ABSTRACT

An energization control apparatus for a glow plug includes a battery, a glow plug, a power control unit, and an energization controller. The glow plug has a low rated voltage which allows rapid heating at a low battery voltage during cranking of a diesel engine in a severe wintertime condition. The power control unit is arranged between the battery and the glow plug to control a power supplied to the glow plug. The energization controller controls the power control unit so as to equalize a root-mean-square value of a voltage applied to the glow plug to be the low rated voltage when a voltage applied to the glow plug at the start of the diesel engine is detected to be higher than the low battery voltage.

9 Claims, 11 Drawing Sheets

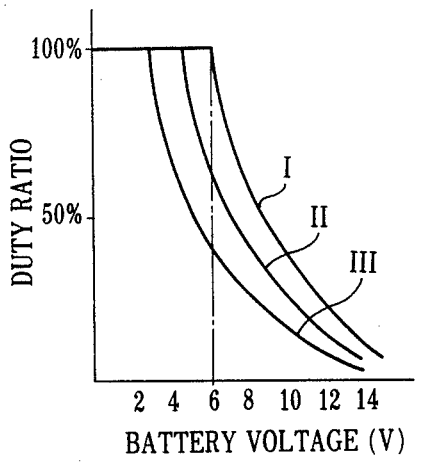
FIG.2
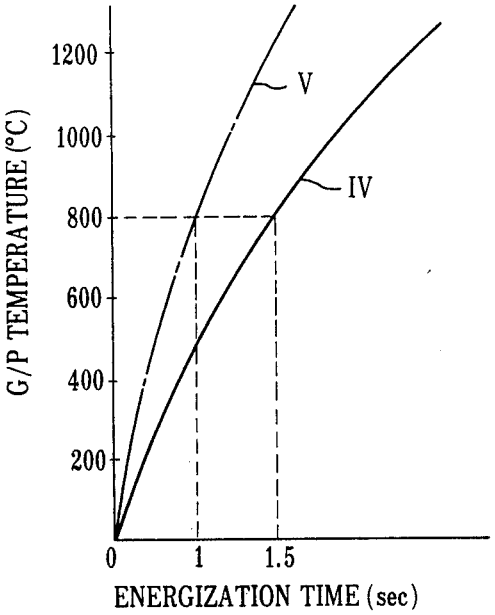
FIG.3
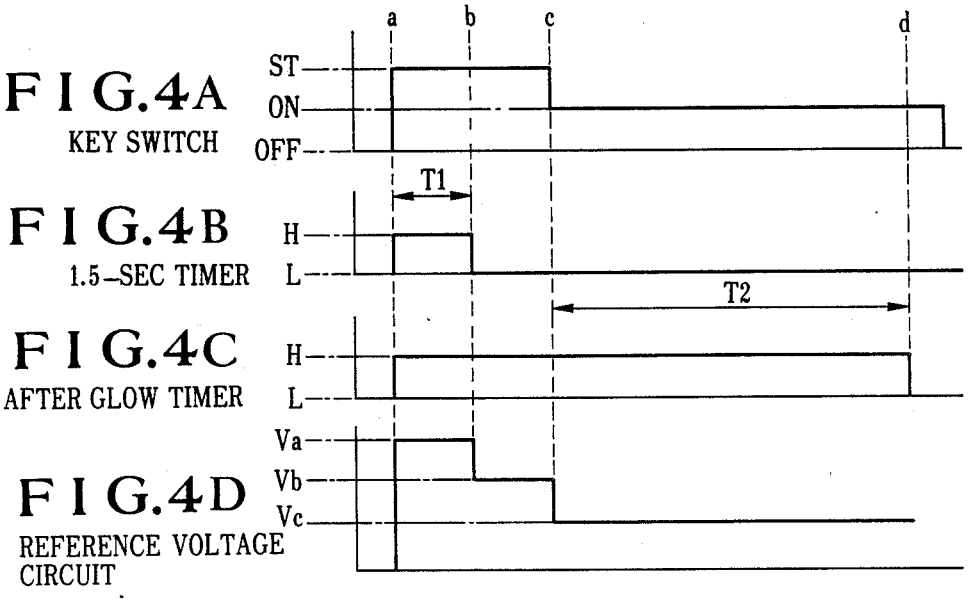
FIG.4A
FIG.4B
FIG.4C
FIG.4D a
b
d
e
g
f

KEY SWITCH 102
ST
ON
OFF

INDICATOR LAMP TIMER 115
T4
c
H
L

CHARGE LAMP 118
ON
OFF

RAPID PRFHEATING TIMER 107
T1
H
L

AND 1 OUTPUT
T3
H
L

ON STATE TIMER 109
T2
H
L

OUTPUT FROM WATER TEMPERATURE DETECTOR 105 TO AND 1
H
L

TRANSISTOR Tr2
ON
OFF
PWM

GLOW PLUG TEMPERATURE g

T4

T1

T2

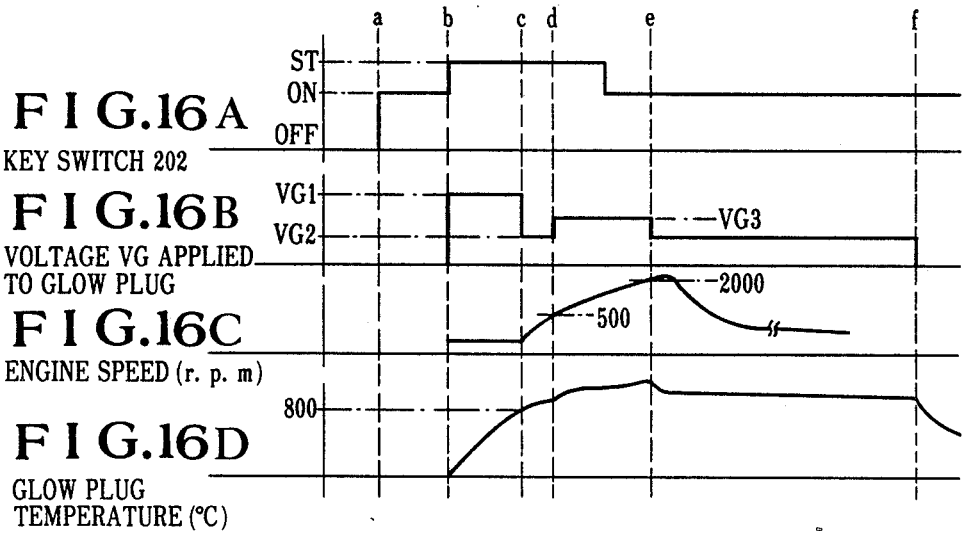
FIG.16A
FIG.16B
FIG.16C
FIG.16D
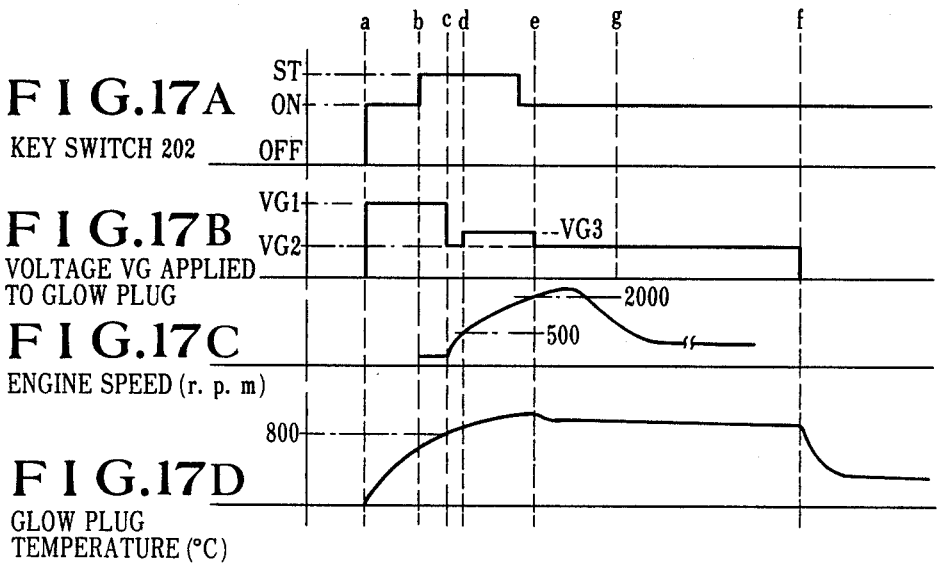
FIG.17A
FIG.17B
FIG.17C
FIG.17D

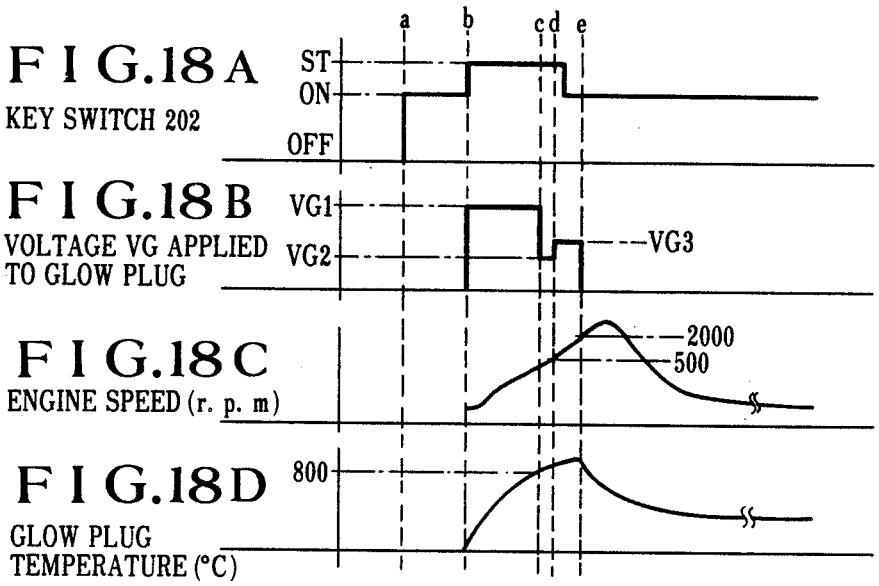
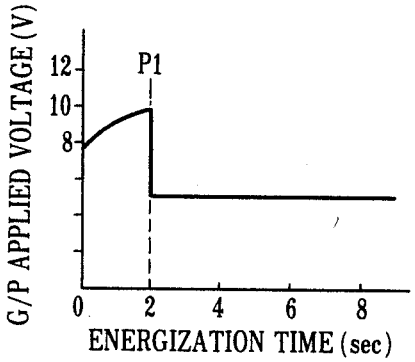
FIG.19
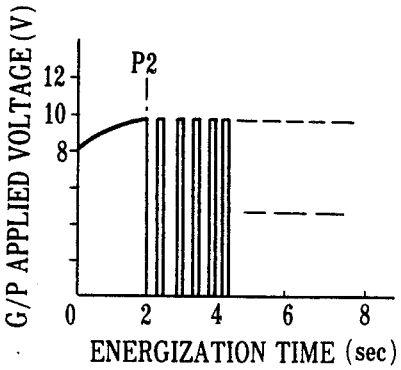
FIG.20
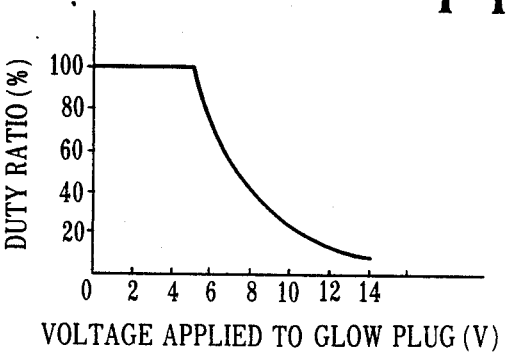
FIG.21

ENERGIZATION CONTROL APPARATUS FOR GLOW PLUG

BACKGROUND OF THE INVENTION

The present invention relates to an energization control apparatus for a glow plug in a diesel engine.

A glow plug extends into each combustion chamber of a cylinder head to facilitate smooth starting of a conventional diesel engine in a cold season. At the start of an engine operation, the glow plug is energized and heated to increase a temperature of compressed air in the cylinder head, thereby assuring starting of the diesel engine. In order to improve operability of the diesel engine to a degree equivalent to a gasoline engine, demand has arisen for a glow plug which has preheating time of almost zero second before the start of the engine. In general, in such a glow plug, a power is controlled through an energization control apparatus which is operated upon connection of a key switch to an ON mode position. A high power is supplied to the glow plug to achieve rapid heating. For a certain period of time after rapid heating, a low power is supplied to the glow plug to achieve stable heating. In general, stable heating of the glow plug upon starting of the engine is called an after glow operation. The interior of the combustion chamber can be warmed up by the after glow operation, and at the same time, knocking of the diesel engine can be prevented. In addition, generation of noise and white smoke and exhaust of the HC component can be prevented.

The power supply cycle of the glow plug by using the above energization control apparatus is generally performed as follows. In the initial energization period, a battery voltage (normally 8 to 10 V) is directly applied to the glow plug to obtain the above high power for rapid heating. When the temperature of the glow plug reaches a predetermined temperature by rapid heating, the glow plug is connected in series with a voltage-drop resistor (i.e., a dropping resistor) to lower the voltage applied to the glow plug, thereby obtaining the low power for the after glow operation. FIG. 19 is a graph showing energization control characteristics when the low power for the after glow operation is obtained by using the dropping resistor. At time P1 after a lapse of two seconds upon the start of energization, the voltage applied to the glow plug can be decreased by connecting the dropping resistor thereto.

In addition to the direct voltage drop by means of the dropping resistor, a low power for the after glow operation can also be obtained by the following indirect method. The voltage for rapid heating is intermittently applied to the glow plug, and the intermittent time is duty-controlled to decrease an RMS voltage. This method is described in Japanese Patent Laid-Open (Kokai) No. 59-122782. An energization control apparatus for the glow plug in this prior art produces a low power supplied to the glow plug during stable heating by intermittently applying a power source voltage to the glow plug. That is, a voltage of an envelope obtained by connecting ON peaks of the voltages intermittently applied to the glow plug is generated to obtain a reference voltage which is continuously changed such that a magnitude of the reference voltage is small for a high envelope voltage and large for a low envelope voltage. The average voltage of the ON and OFF times of the voltages intermittently applied to the glow plug is always compared with the reference voltage. Negative feedback control is performed to cause the average voltage to coincide with the reference voltage or set the average voltage in proportion thereto. An RMS voltage applied to the glow plug is kept constant regardless of the ON voltage applied to the glow plug. That is, the low power supplied to the glow plug is kept constant regardless of variations in power source voltage. Therefore, the temperature of the glow plug during stable heating can be kept constant.

As indicated by the energization control characteristics in FIG. 20, an ON/OFF time of the voltage applied to the glow plug is duty-controlled at time P2 after the start of energization of the glow plug. The RMS value of the voltage applied to the glow plug is decreased to obtain the low power for stable heating. The duty ratio is set to be variable according to the voltage applied to the glow plug, as shown in FIG. 21. Therefore, the low power supplied to the glow plug during stable heating is kept constant regardless of changes in values of the voltages applied to the glow plug.

In the conventional energization control apparatus for the glow plug described above, when a key switch is connected to an ON mode position and at the same time a starter mode position to achieve cranking during the severe wintertime (strict winter condition) which corresponds to an outer air temperature of −10° C. or less, (i.e., when quick starting of almost zero second is to be performed), an excessive cranking power is required, and a battery voltage is greatly lowered (up to 6 to 7 V in a normal operation condition). As a result, a voltage applied to the glow plug to achieve rapid heating thereof cannot be sufficiently assured. That is, since the glow plug cannot be rapidly heated at the time of starting of the engine, its starting characteristics are greatly degraded, and quick starting of almost zero second is difficult to perform.

The conventional energization control apparatus for the glow plug has an advantage in that the low power supplied to the glow plug during stable heating can be kept constant. However, this apparatus cannot compensate for a decrease in glow plug temperature against fuel spray swirl generated in the combustion chamber during cranking of the engine. That is, negative feedback control of the low power supplied to the glow plug can be performed to compensate for a decrease in power source voltage during cranking of the engine. A control value is given as a predetermined value. When the fuel spray swirl generated inside the combustion chamber acts on the glow plug during cranking, a decrease in temperature of the glow plug cooled by this fuel spray swirl cannot be compensated, thereby degrading the starting characteristics of the engine.

In addition, since the low power supplied to the glow plug during stable heating is kept unchanged and when an ambient temperature is decreased, a glow plug temperature is decreased accordingly. In severe wintertime (severe winter condition) having an ambient temperature of lower than a predetermined temperature (e.g., −15° C.), starting characteristics of the engine are degraded.

According to the conventional method of controlling energization of the glow plug as described above, in an extremely low temperature state (i.e., severe winter condition) having an outer air temperature of −15° C. or less, even if the key switch is connected to the ON mode position and at the same time a high power is supplied to the glow plug to achieve rapid heating, the starting characteristics of the engine are not necessarily improved. That is, a viscosity of fuel (light oil) in the severe winter condition is increased, and a spray particle size is increased. When the key switch is connected to the ON mode position and at the same time the high power is supplied to the glow plug, the temperature of the glow plug is excessively increased at the start of fuel injection during cranking, thus resulting in poor ignition.

After the start of cranking, a perfect combustion time, i.e., "rev-up" time from the first ignition to perfect ignition is prolonged. In particular, in a severe winter condition, the perfect combustion time is further prolonged.

SUMMARY OF THE INVENTION

It is, therefore, a principal object of the present invention to provide an energization control apparatus for a glow plug, wherein stable quick starting is performed even in the severe wintertime.

In order to achieve the above object of the present invention, there is provided an energization control apparatus for a glow plug, comprising a battery, a glow plug having a low rated voltage which allows rapid heating at a low battery voltage during cranking of a diesel engine in a severe wintertime condition, power control means, arranged between the battery and the glow plug, for controlling a power supplied to the glow plug, and energization control means for controlling the power control means so as to equalize a root-mean-square value of a voltage applied to the glow plug to be the low rated voltage when a voltage applied to the glow plug at the start of the diesel engine is detected to be higher than the low battery voltage.

BRIEF DESCRIPTION OF THE DRAWINGS

FIG. 2 is a graph showing duty ratio characteristics with respect to battery voltage values selected by a duty control circuit in the energization control apparatus for the glow plug;

FIG. 3 is a graph showing glow plug rapid heating characteristics used in the energization control apparatus for a glow plug;

FIGS. 4A to 4D are timing charts for explaining the operation of the energization control apparatus shown in FIG. 1;

FIGS. 16A to 16D are timing charts for explaining energization control states of the glow plug in a severe winter condition range in the energization control apparatus shown in FIG. 15;

FIGS. 17A to 17D are timing charts for explaining energization control states of the glow plug in a normal operation condition range in the energization control apparatus in FIG. 15;

FIGS. 18A to 18D are timing charts for explaining energization control states of the glow plug in the energization control apparatus of FIG. 15 after the engine is started;

FIGS. 19 and 20 are graphs showing energization control characteristics of a conventional glow plug; and FIG. 21 is a graph showing a relationship between the voltage applied to the glow plug and the duty ratio in the energization control apparatus.

DESCRIPTION OF THE PREFERRED EMBODIMENTS

Energization control apparatuses for glow plugs according to preferred embodiments of the present invention will be described below.

Figure 1:
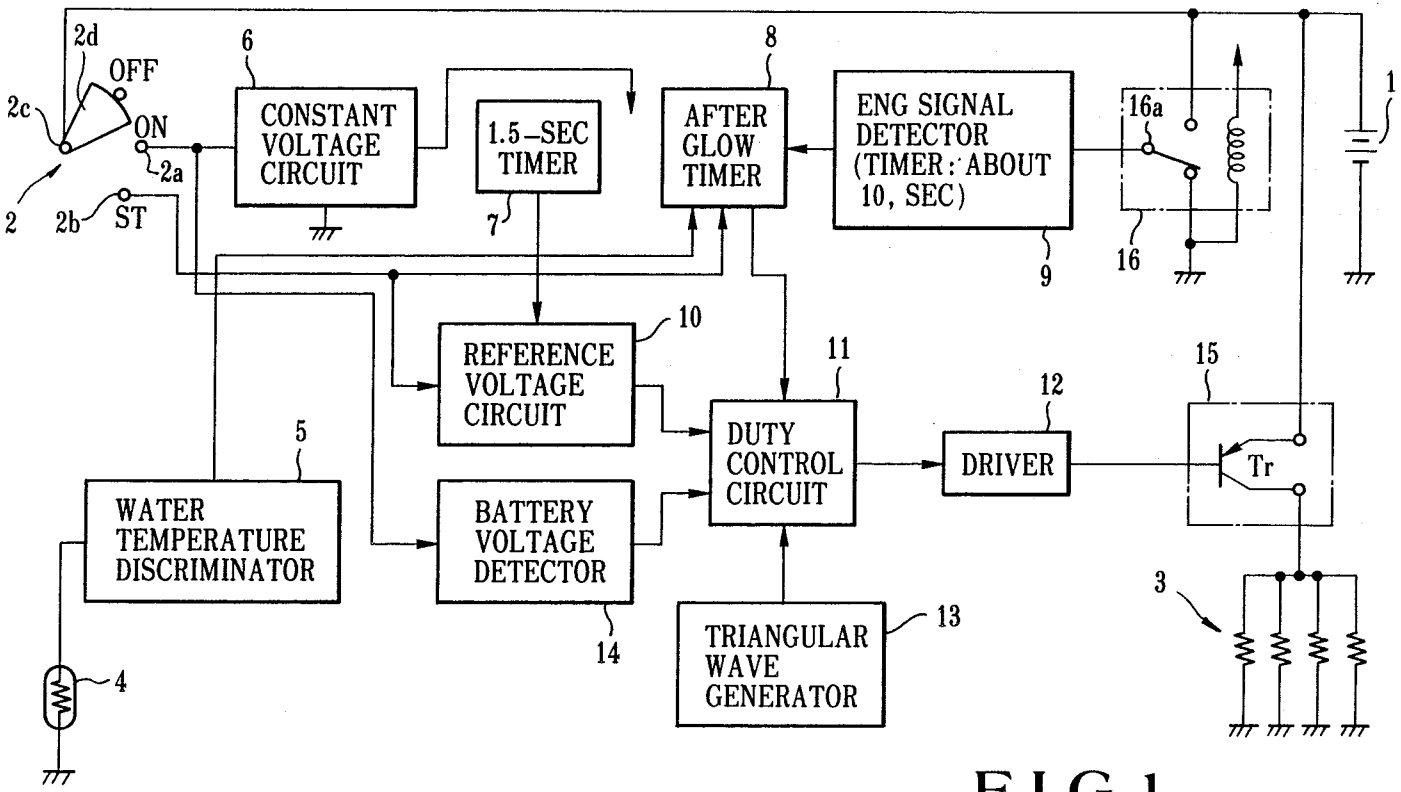
FIG. 1 is a block diagram of an energization control apparatus for a glow plug according to an embodiment of the present invention.

FIG. 1 shows an energization control apparatus for a glow plug according to an embodiment of the present invention.

Referring to FIG. 1, reference numeral 1 denotes a battery; 2, a key switch; 3, a glow plug (four glow plugs are illustrated in the embodiment) partially extending into each combustion chamber (not shown) of a cylinder head of a diesel engine; 4, a water temperature sensor for discriminating a temperature of cooling water of the engine; 5, a water temperature discriminator for discriminating a cooling water temperature detected by the water temperature sensor 4; and 6, a constant voltage circuit connected to an ON terminal 2*a* of the key switch 2.

The glow plug used in this case has a low rated voltage which allows rapid heating at a low battery voltage during cranking of the diesel engine in a severe wintertime condition. Therefore, the low rated voltage is set to be lower than a minimum battery voltage obtained during cranking upon operation of a starter of the diesel engine in the severe wintertime condition.

A glow plug used herein includes a ceramic heater, and its structure is described in U.S. Pat. No. 4,742,209. A resistive ceramic heater material is $\beta$-SIALON available from Hitachi Metal Ltd. or a material prepared by mixing titanium nitride to a SIALON including $\alpha$-phase or $\beta$-phase or $(\alpha+\beta)$-phase. Any other resistive ceramic material may be used to obtain the same effect as in SIALON.

The constant voltage circuit 6 receives a battery voltage through the ON terminal 2*a* of the key switch 2 and applies drive voltages to a 1.5-sec timer 7, an after glow timer 8, an engine (ENG) singal detector 9, a reference voltage circuit 10, a duty control circuit 11, a driver 12, a triangular wave generator 13, a battery voltage detector 14, and the water temperature discriminator 5. The 1.5-sec timer 7 and the after glow timer 8 are started when a movable contact 2*d* of the key switch 2 is connected to the ON terminal 2*a*. The 1.5-sec timer 7 continuously outputs a timer signal of "H" level to the reference voltage circuit 10 until a lapse of timer time T1 (T=1.5 sec in this embodiment). The after glow timer 8 continuously outputs a timer signal of "H" level to the duty control circuit 11 until a lapse of timer time T2 (T2>T1). The time T2 set in the after glow timer 8 is set to be variable in accordance with a detected cooling water temperature input thereto through the water temperature discriminator 5. The counting operation of the after glow timer 8 is reset whenever the movable contact 2*d* of the key switch 2 is separated from a starter terminal 2*b*, thereby restarting the counting operation.

A starter signal of "H" level is input to the reference voltage circuit 10 when the movable contact 2*d* of the key switch 2 is connected to the starter terminal 2*b*. When the starter signal is kept at "H" level and the timer signal output from the 1.5-sec timer 7 is kept at "L" level, a reference voltage Vb is applied to the duty control circuit 11 through the reference voltage circuit 10. When the timer signal output from the 1.5-sec timer 7 is set at "H" level, a reference voltage Va is applied to the duty control circuit 11 through the reference voltage circuit 10. When the timer signal from the 1.5-sec timer 7 and the starter signal are set at "L" level, a reference voltage Vc is applied to the duty control circuit 11 through the reference voltage circuit 10. Instantaneous potentials at the ON terminal 2*a* of the key switch 2, i.e., instantaneous battery voltage values of the battery 1 are input to the duty control circuit 11 through the battery voltage detector 14. The duty control circuit 11 selects a proper duty ratio from characteristic curves I to III in FIG. 2 on the basis of the battery voltage value input through the battery voltage detector 14 and the reference voltage value output from the reference voltage circuit 10. A pulse signal having the selected duty ratio is generated by using a triangular wave input from the triangular wave generator 13. The generated pulse signal is output to the driver 12. ON/-OFF driving of a power transistor Tr in a power control unit 15 is performed in accordance with the pulse signal input to the driver 12. The emitter of the transistor Tr is connected to the positive terminal of the battery 1, and the glow plug 3 is connected between ground and the collector of the transistor Tr. A method of selecting the duty ratio by the duty control circuit 11 will be described below. When the reference voltage Va is output from the reference voltage circuit 10 to the duty control circuit 11, a duty ratio corresponding to a battery voltage value is given by the characteristic curve I so as to set a rapid heating mode. When the reference voltage Vb is output, a duty ratio corresponding to a battery voltage value is given by the characteristic curve II so as to set a cranking mode. Similarly, when the reference voltage Vc is output, a duty ratio corresponding to a battery voltage value is given by the characteristic curve III so as to set an after glow mode.

FIG. 3 shows rapid heating characteristic curves employed in the energization control apparatus of this embodiment. For example, when a voltage applied to the glow plug is given as 6 V, a rapid heating characteristic curve IV is obtained, as indicated by the solid curve. More specifically, a high-performance glow plug is employed so that the temperature of the glow plug can reach 800° C. within 1.5 sec when a voltage of 6 V is applied to this glow plug. A conventional glow plug requires a voltage of, e.g., 9 V to obtain the rapid heating characteristic curve IV. When the glow plug 3 employed in this embodiment is used, a rapid heating characteristic curve V indicated by the alternate long and short dashed line is obtained. In the energization control apparatus in FIG. 1, reference numeral 16 denotes a charge relay whose movable contact 16*a* is grounded. Signals of "L" and "H" levels through the movable contact 16*a* of the charge relay are input as engine signals to the engine signal detector 9. If the engine signal is not set at "H" level, i.e., if the engine is not operated even when 10 seconds have elapsed after a connection of the movable contact 2*d* of the key switch 2 to the ON terminal 2*a*, the engine signal detector 9 outputs a signal for focibly stopping counting of the after glow timer 8 to the after glow timer 8 on the basis of the engine signal received through the charge relay 16. When counting of the after glow timer 8 is ended or forcibly stopped, generation of the pulse signal in the duty control circuit 11 is interrupted. The transistor Tr in the power control unit 15 is kept off.

An operation of the energization control apparatus for a glow plug having the above arrangement will be described below. Assume that the key switch 2 is operated to perform quick starting of about zero second so that the movable contact 2*d* is connected to the starter terminal 2*b* while being connected to the ON terminal 2*a* (i.e., time a in FIG. 4A). In this case, when the movable contact 2*d* is connected to the ON terminal 2*a*, drive voltages are supplied to the 1.5-sec timer 7, the after glow timer 8, the engine signal detector 9, the reference voltage circuit 10, the duty control circuit 11, the driver 12, the triangular wave generator 13, the battery voltage detector 14, and the water temperature discriminator 5. The 1.5-sec timer 7 and the after glow timer 8 are started when the movable contact 2*d* of the key switch 2 is connected to the ON terminal 2*a*. A timer signal of "H" level is supplied to the reference voltage circuit 10 through the 1.5-sec timer 7 (time a in FIG. 4B). A timer signal of "H" level is supplied to the duty control circuit 11 through the after glow timer 8 (time a in FIG. 4C). When the reference voltage circuit 10 receives the timer signal of "H" level from the 1.5-sec timer 7, the reference voltage circuit 10 supplies the reference voltage Va to the duty control circuit 11 (time a in FIG. 4D). The duty control circuit 11 selects the characteristic curve I of the characteristic curves I to III shown in FIG. 2 on the basis of the reference voltage Va. A duty ratio corresponding to the present battery voltage value is derived on the basis of the characteristic curve I. A pulse signal having the obtained duty ratio is supplied to the driver 12.

If quick starting of about zero second of the engine is performed in the severe wintertime, a high cranking power is required to greatly decrease a voltage value of the battery 1. For example, if a decreased voltage value of the battery which is detected by the battery voltage detector 14 reaches 6 V, the duty ratio of the pulse signal generated by the duty control circuit 11 on the basis of the characteristic curve I is 100%. The transistor Tr is kept on in response to the pulse signal output through the driver 12. That is, the voltage of 6 V as a decreased voltage value is applied to each glow plug 3 through the transistor Tr. The glow plug 3 starts rapid heating in accordance with the characteristic curve IV shown in FIG. 3. When the time T1 (1.5 sec) set in the 1.5-sec timer 7 has elapsed, a timer signal supplied to the reference voltage circuit 10 goes low (time b in FIG. 4B). Therefore, the reference voltage set in the duty control circuit 11 through the reference voltage circuit 10 becomes Vb (time b in FIG. 4D). After the reference voltage value of the duty control circuit 11 is set to be Vb, a duty ratio corresponding to the present battery voltage value is derived on the basis of the characteristic curve II in FIG. 2. The pulse signal having the derived duty ratio is supplied to the driver 12. The RMS value of the voltage applied to the glow plug 3 is set to be 4.5 V by the transistor Tr which is on/off driven by the output from the driver 12. Therefore, the temperature of the glow plug 3 reaches 800° C. according to the rapid heating characteristic curve IV. During cranking, the RMS voltage of 4.5 V is applied, and the glow plug temperature is kept at a high temperature of, e.g., 1,000° C. For this reason, even if a battery voltage value is greatly decreased at the start of the engine in the severe wintertime, quick starting of about zero second can be properly performed.

When the movable contact **2*d* of the key switch 2 is released from the starter terminal 2*b* (time c in FIG. 4A), the starter signal is set to be "L" level, and the reference voltage value set in the duty control circuit 11 through the reference voltage circuit 10 becomes Vc (time c in FIG. 4D). After the reference voltage value set in the duty control circuit 11 becomes Vc, a duty ratio corresponding to the present battery voltage value is derived on the basis of the characteristic curve III in FIG. 2. The RMS value of the voltage applied to the glow plug 3 is set to be 3 V by the pulse signal having the derived duty ratio. In this manner, by decreasing the RMS voltage, the temperature of the glow plug during the after glow operation is kept at about 800° C., so that the service life of the glow plug is prolonged. Counting of the after glow timer 8 is reset at time c in FIG. 4C, and is restarted. When the time T2 has elapsed at time d in FIG. 4C, the timer signal goes low. Generation of the pulse signal by the duty control circuit 11 is interrupted in response to the timer signal of "L" level through the after glow timer 8. By this interruption of generation of the pulse signal, the transistor Tr is kept off, and supply of power to the glow plug 3 is interrupted. That is, during a time interval from time c to time d, i.e., time T2, the RMS value of the voltage applied to the glow plug 3** is kept to be 3 V, and stable heating after rapid heating can be achieved.

During the time interval between time b and time c in FIGS. 4A to 4D, the RMS value of the voltage applied to the glow plug 3 is set to be 4.5 V because a decrease in temperature of the glow plug 3 by light oil as fuel and a compressed air flow must be compensated. When the engine signal of "H" level is not detected even after a lapse of 10 seconds in the engine signal detector 9, that is, when the movable contact **2*d* of the key switch 2 is not connected to the start terminal 2*b* after a lapse of 10 seconds upon a connection of the movable contact 2*d* to the ON terminal 2*a*, counting of the after glow timer 8 is forcibly stopped. Generation of the pulse signal in the duty control circuit 11 is interrupted. The transistor Tr in the power control unit 15 is forcibly kept off, and therefore, subsequent supply of the power to the glow plug 3** is immediately interrupted.

Figure 5:
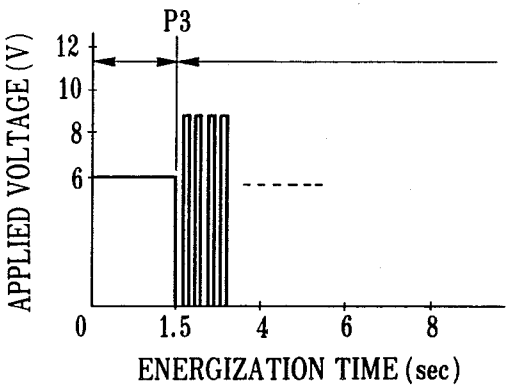
FIG. 5 is a graph showing characteristics of voltages applied to the glow plug at the time of zero-sec starting of a diesel engine during the severe wintertime.
Figure 6:
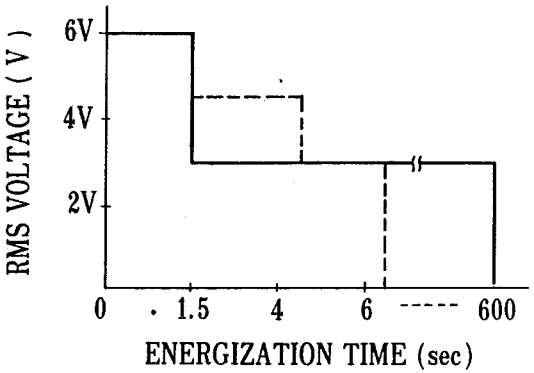
FIG. 6 is a graph obtained by rewriting these voltage characteristics by using RMS (root-mean-square) levels.

In the above description, the movable contact **2*d* of key switch 2 is kept connected to the start mode position to perform cranking of the engine even after a lapse of the time T1 in the 1.5-sec timer 7. However, if cranking of the engine is completed during the time T1 of the 1.5-sec timer 7, the key switch 2 is returned to the ON mode position during a time interval from time a to time b in FIG. 4A. When the time T1 of the 1.5-sec timer 7 has elapsed, the reference voltage value of the duty control circuit 11 through the reference voltage circuit 10 is immediately set to be Vc. The RMS value of the voltage applied to the glow plug 3 is not set to be 4.5 V as the boosting voltage value of cranking, but is immediately decreased to 3 V. FIG. 5 shows change characteristics of voltages applied to the glow plug 3 in this operation. After time P3 upon a lapse of 1.5 sec, a voltage applied to the glow plug 3 is intermittently controlled so that its RMS value is kept to be 3 V. FIG. 6 is a graph obtained by rewriting the change characteristics of the voltage by RMS voltage levels. After a lapse of 1.5 sec upon the start of energization, the RMS voltage value is decreased from 6 V to 3 V, and thereafter the RMS voltage value of 3 V is intermittently applied to the glow plug 3 until the time T2 of the after glow timer 8 has elapsed (T2=600 sec in FIG. 6). A characteristic curve indicated by the broken line indicates a change in RMS value of the boosting voltage of 4.5 V applied to the glow plug. A characteristic curve indicated by the alternate long and short dashed line in FIG. 6 represents forcible interruption characteristics when the key switch 2** is kept at the ON mode position.

Figure 7:
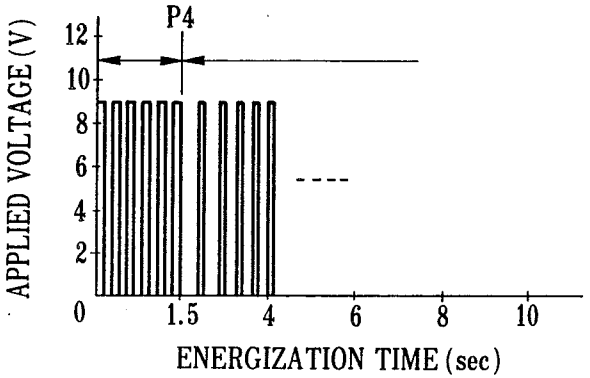
FIG. 7 is a graph showing characteristics of voltages applied to the glow plug at the time of zero-sec starting of the engine during warming-up.

In the above embodiment, quick starting of about zero second of the engine during the severe wintertime is exemplified. However, quick starting of about zero second in a warm season can be performed in the following manner. More specifically, during cranking of the engine in a warm season, a voltage drop of the battery 1 is small, and its voltage is higher than 6 V. While the reference voltage Va is set in the duty control circuit 11 by the reference voltage circuit 10 (i.e., for 1.5 sec upon the start of the engine), the duty ratio of the voltage applied to the glow plug 3 is controlled even within 1.5 sec upon the start of engine in accordance with a pulse signal having a duty ratio derived on the basis of the characteristic curve I. The RMS value of the voltage applied to the glow plug is maintained to be 6 V, as indicated by change characteristics of the voltage applied to the glow plug in FIG. 7. If these change characteristics are represented by RMS value levels, the same characteristics as in FIG. 5 can be obtained. That is, when a voltage of 6 V or higher is directly applied to the glow plug 3 during engine cranking in a warm season, duty control of the voltage applied to the glow plug 3 is performed such that its RMS value is set to be 6 V. Overheating of the glow plug 3 by an excessively high power can be prevented. Cracking caused by a rapid temperature rise can be prevented. Since the RMS voltage value of the glow plug 3 is kept at a predetermined value, requirements for temperature rise variations of the glow plug used are not so strict. Reduction in cost can be expected.

In this embodiment, a high-performance glow plug is used which requires an energization time of 1.5 sec for heating the plug to 800° C. at a voltage of 6 V. It is preferable that an energization time required for heating the plug to 800° C. at a voltage of 6 V falls within 3 seconds so as to allow quick starting of about zero second which is excellent in starting characteristics.

In the energization control apparatus for a glow plug according to this embodiment, a high-performance glow plug is prepared which requires a minimum value of a rapid heating voltage to be smaller than a battery voltage lowered at the start of the diesel engine in the severe wintertime. The voltage applied to this high-performance glow plug is monitored. When the voltage applied to the glow plug is lower than the lowered battery voltage, the RMS value of this voltage is decreased to be about equal to the decreased battery voltage value. Even if the battery voltage is greatly lowered during starting of the diesel engine in the severe wintertime, rapid heating of the glow plug can be performed on the basis of the lowered battery voltage. Therefore, quick starting of about zero second of the engine can be optimally performed. When a voltage which is higher than the decreased battery voltage is applied to the glow plug, the voltage applied to the glow plug is controlled to be almost equal to the decreased battery voltage. Overheating of the glow plug during starting of the engine in a warm season can be prevented, and cracking of the engine by rapid temperature rise can also be prevented. Since the RMS value of the voltage applied to the glow plug can always be kept constant, requirements for temperature rise variations in glow plug used are not so strict. Reduction in cost can be expected.

Figure 8:
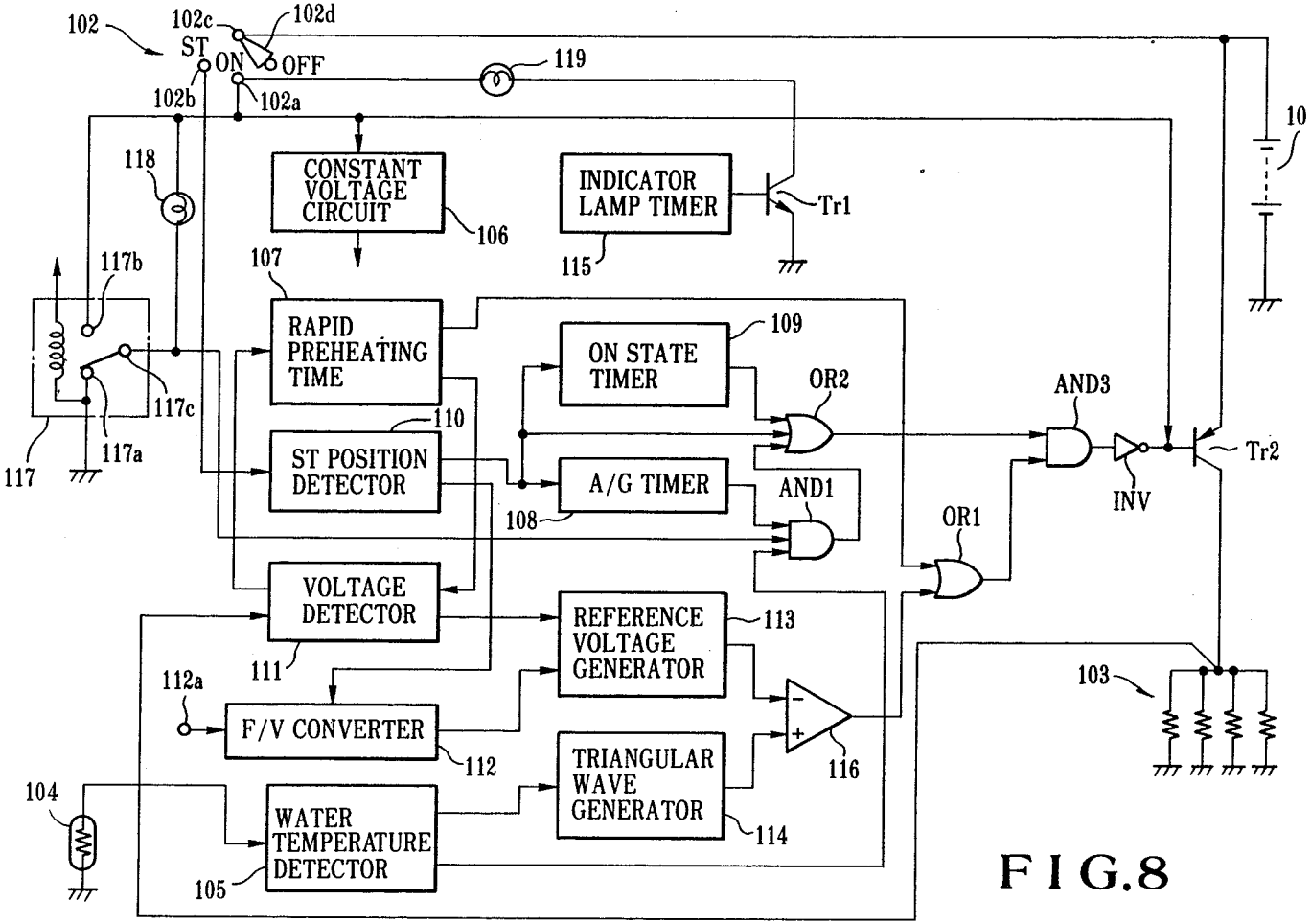
FIG. 8 is a block diagram of an energization control apparatus for a glow plug according to another embodiment of the present invention.

FIG. 8 shows an energization control apparatus for a glow plug according to another embodiment of the present invention.

Referring to FIG. 8, reference numeral 101 denotes a battery; 102, a key switch; 103, a glow plug partially extending in each combustion chamber (not shown) of a cylinder head of a diesel engine; 104, a water temperature sensor for detecting a cooling water temperature of the engine; 105, a water temperature discriminator for discriminating a cooling water temperature detected by the water temperature sensor 104; and 106, a constant voltage circuit connected to an ON terminal 102*a* of the key switch 102.

The constant voltage circuit 106 receives a battery voltage through the ON terminal 102*a* of the key switch 102 and supplies drive voltages to the water temperature discriminator 105, a rapid preheating timer 107, an after glow timer 108, an ON state timer 109, an ST position detector 110, a voltage detector 111, an F/V (frequency/voltage) converter 112, a reference voltage generator 113, a triangular wave generator 114, and an indicator lamp timer 115. The rapid preheating timer 107, the ON state timer 109, and the indicator lamp timer 115 are started when a movable contact 102*d* of the key switch 102 is connected to the ON terminal 102*a*. The rapid preheating timer 107 continuously outputs a timer signal of "H" level to an OR gate OR1 and the voltage detector 111 until its timer time T1 has elapsed. The ON state timer 109 continuously outputs a timer signal of "H" level to an OR gate OR2 until its timer time T2 (T2=10 sec: T2>T1) has elapsed. The indicator lamp timer 115 continuously outputs a timer signal of "H" level to the base of an npn transistor Tr1 until its timer time T4 (T4=1.5 sec in this embodiment) has elapsed. The transistor Tr1 is turned on in response to the timer signal of "H" level from the indicator lamp timer 115, and an indicator lamp 119 connected between the collector of the transistor Tr1 and the ON terminal 102*a* of the key switch 102 is turned on. The after glow timer 108 is started in response to an ST position detection signal output from the ST position detector 110. Counting of the after glow timer 108 is started when the ST position detection signal goes low. The after glow timer 108 continuously outputs a timer signal of "H" level to an AND gate AND1 until its predetermined timer time T3 (T3=10 minutes in this embodiment) has elapsed. The ST position detection signal output through the ST position detector 110 goes high when a movable contact 102*d* of the key switch 102 is connected to a starter terminal 102*b*. When the movable contact 102*d* is released from the starter terminal 102*b*, the ST position detection signal goes low. The ST position detection signal output from the ST position detector 110 is input to the ON state timer 109 and the OR gate OR2. The timer signal of "H" level output from the ON state timer 109 is forcibly disabled at a leading edge of the ST position detection signal from "L" level to "H" level. The ST position detection signal output from the ST position detector 110 is also input to the F/V converter 112. When the ST position detection signal is set at "H" level, the F/V converter 112 outputs a F/V conversion signal to the reference voltage generator 113. More specifically, a terminal 112*a* of the F/V converter 112 receives an engine speed signal. The F/V converter 112 outputs a voltage signal as the F/V conversion signal corresponding to the engine speed to the reference voltage generator 113 on the basis of the input signal.

Voltages applied to the glow plug 103 (to be referred to as glow voltages hereinafter) are sequentially fed back to and monitored by the voltage detector 111. A value of the timer time T1 set in the rapid preheating timer 107 is set to be variable in accordance with the glow voltage monitored by the voltage detector 111. A reference voltage increased in proportion to an increase in glow voltage monitored by the voltage detector 111 is input to the inverting input terminal of a comparator 116 through the reference voltage generator 113. A triangular wave voltage signal is input from the triangular wave generator 114 to the noninverting input terminal of the comparator 116. The triangular wave voltage signal input from the triangular wave generator 114 is compared with the reference voltage input to the inverting input terminal of the comparator 116. A comparison output is input from the comparator 116 to the OR gate OR1. An output from the OR gate OR1 is input to an AND gate AND3. An output from an inverter INV for inverting an output from the AND gate AND3 is input to the base of a pnp power transistor Tr2. When the transistor Tr2 is turned on, a power source voltage of the battery 101 is applied to the glow plug 103.

A reference level of the triangular wave voltage signal generated by the triangular wave generator 114 is changed in two steps in accordance with a cooling water temperature discrimination value from the water temperature discriminator 105. If a cooling water temperature is discriminated to be less than −15° C., the reference level of the triangular wave voltage signal is set to be a higher level. However, if the cooling water temperature is discriminated to be −15° C. or higher, the reference level of the triangular wave voltage signal is set to be a lower level. While the rapid preheating timer 107 continuously outputs a timer signal of "H" level to the voltage detector 111, the reference voltage set on the basis of the glow voltage monitored by the voltage detector 111 is not supplied from the reference voltage generator 113 to the comparator 116. When the F/V conversion signal corresponding to the engine speed is input from the F/V converter 112, the reference voltage generator 113 decreases the reference voltage value in proportion to an increase in engine speed.

When the cooling water temperature is discriminated to be 60° C. or less by the water temperature discriminator 105, a signal of "H" level is input to the AND gate AND1. An output from the AND gate AND1 is input to the OR gate OR2. An output from the OR gate OR2 is input to the AND gate AND3. Signals of "H" and "L" levels through a movable contact 117*d* of a charge relay 117 are input as engine signals to the AND gate AND1. That is, a normally closed contact terminal 117*a* of the charge relay 117 is normally connected to the ground line. A normally open contract terminal 117*b* of the charge relay 117 is normally connected to the ON terminal 102*a* of the key switch 102. The movable contact 117*d* which is connected to the normally closed contact terminal 117*a* is connected to the normally open contact terminal 117*b* upon engine operation. A charge relay lamp 118 is connected between the normally open contact terminal 117*b* of the charge relay 117 and a common terminal 117*c* thereof.

An operation of the energization control apparatus for a glow plug having the above arrangement will be described below. When the key switch 102 is operated to connect its movable contact 102*d* to the ON terminal 102*a* (time a in FIG. 9A), a battery voltage through the constant voltage circuit 106 is supplied to the water temperature discriminator 105, the rapid preheating timer 107, the after glow timer 108, the ON state timer 109, the ST position detector 110, the voltage detector 111, the F/V converter 112, the reference voltage generator 113, the triangular wave generator 114, and the indicator lamp timer 115. The indicator lamp timer 115, the rapid preheating timer 107, and the ON state timer 109 are started (time a in FIGS. 9B, 9D, and 9F) upon reception of the drive voltages through the constant voltage circuit 106. Timer signals of "H" level are input from the indicator lamp timer 115, the rapid preheating timer 107, and the ON state timer 109 to the transistor Tr1, the OR gate OR1, and the OR gate OR2. Therefore, the transistor Tr1 is turned on to turn on the indicator lamp 119. Outputs of "H" level from the OR gates OR1 and OR2 are gated through the AND gate AND3. The transistor Tr2 is driven through the inverter INV (time a in FIG. 9H). Upon driving of the transistor Tr2, the power source voltage from the battery 101 is applied to the glow plug 103, and the temperature of the glow plug 103 is rapidly increased (time a in FIG. 9I). The charge lamp 118 is turned on upon operation of the key switch 102 and connection of the movable contact 102*d* to the ON terminal 102*a* by a current path consisting of the ON terminal 102*a*, the movable contact 117*d* of the charge relay 117, and the normally closed contact terminal 117*a* of the charge relay 117 (time a in FIG. 9C).

When the timer time T1 of the rapid preheating timer 107 has elapsed and its timer signal goes low (time b in FIG. 9D), the reference voltage based on the glow voltage monitored by the voltage detector 111 is supplied from the reference voltage generator 113 to the comparator 116. The reference voltage input to the comparator 116 is compared with the triangular wave voltage signal from the triangular wave generator 114. A comparison output from the comparator 116 is input to the OR gate OR1. That is, a PWM-modulated signal having a predetermined duty ratio determined on the basis of the reference voltage input to the inverting input terminal of the comparator 116 is input to the OR gate OR1. The timer signal of "H" level input from the rapid preheating timer 107 to the OR gate OR1 is disabled. Thereafter, the PWM-modulated signal output from the comparator 116 is gated through the OR gate OR1. The PWM-modulated signal through the OR gate OR1 is further gated through the AND gate AND3. The output from the AND gate AND3 is inverted by the inverter INV, and the inverted signal controls the ON/OFF operation of the transistor Tr2 (time b in FIG. 9H). That is, at this time, rapid heating of the glow plug 103 by using a high power is completed, and stable heating with a low power is initiated.

When the timer time T4 of the indicator lamp timer 115 has elapsed (time c in FIG. 9B), the transistor Tr1 is turned off and the indicator lamp 119 is also turned off. When the indicator lamp 119 is turned off, the movable contact 102*d* of the key switch 102 is connected to the starter terminal 102*b* while the movable contact 102*d* is kept connected to the ON terminal 102*a* (time d in FIG. 9A). The connection of the movable contact 102*d* of the key switch 102 to the starter terminal 102*b* is detected by the ST position detector 110. While the movable contact 102*d* is kept connected to the starter terminal 102*b*, the ST position detector 110 outputs an ST position detection signal of "H" level. The timer singal of "H" level output from the ON state timer 109 is disabled at the leading edge of the ST position detection signal from "L" level to "H" level on the basis of the ST position detection signal output from the ST position detector 110 (time d in FIG. 9F). However, at this time, the OR gate OR2 gates the ST position detection signal of "H" level input through the ST position detector 110. Therefore, the PWM-modulated signal gated through the OR gate OR1 is continuously gated through the AND gate AND3. The output from the AND gate AND3 controls ON/OFF driving of the transistor Tr2 through the inverter INV.

Figures 9A, 9B, 9C, 9D, 9E, 9F, 9G, 9H, 9I:
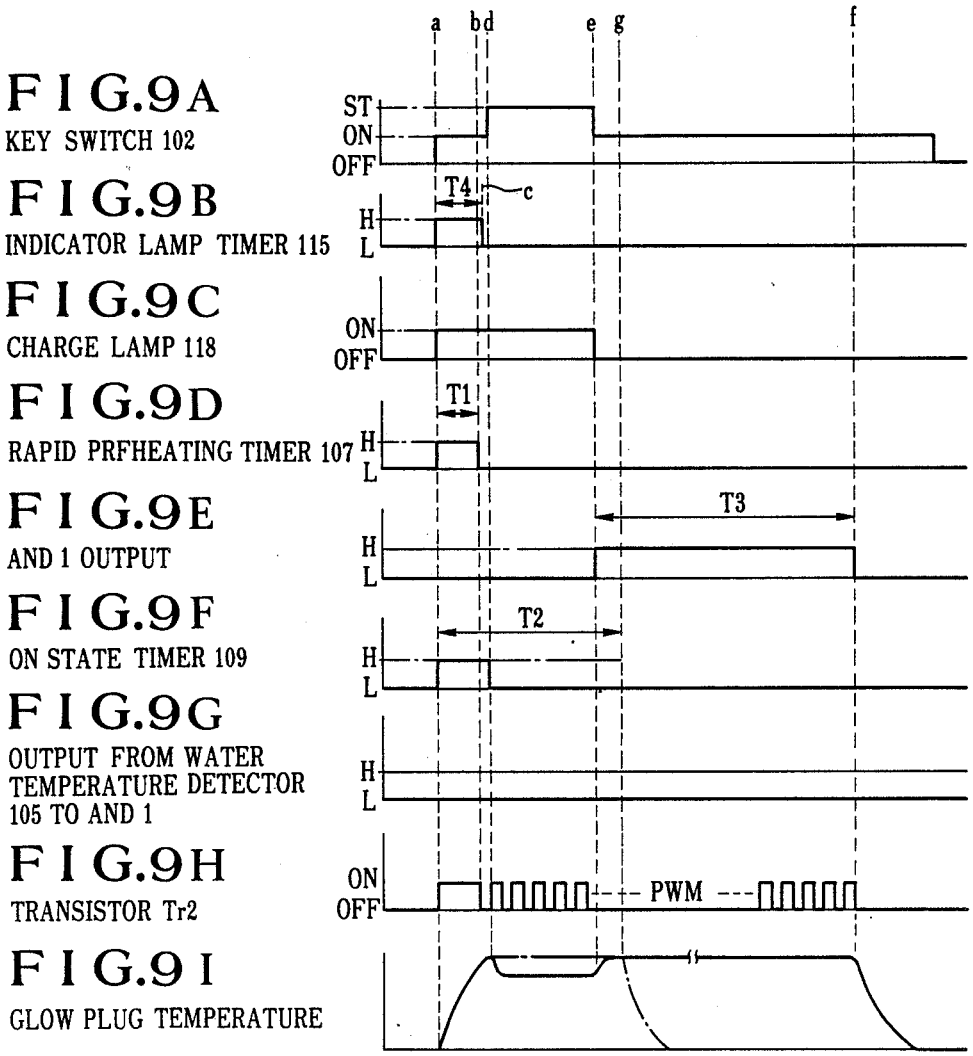
FIGS. 9A to 9I are timing charts for explaining the basic operation of the energization control apparatus for a glow plug shown in FIG. 8.

When the engine is rotated, i.e., when the charge lamp 118 is turned off (time e in FIG. 9C), the movable contact 102*d* of the key switch 102 is disconnected from the starter terminal 102*b* and connected to the ON terminal 102*a* (time e in FIG. 9A). The ST position detection signal output from the ST position detector 110 goes low, and counting of the after glow timer 108 is started at the trailing edge of the ST position detection signal. A timer signal of "H" level is input from the after glow timer 108 to the AND gate AND1. In this case, the second input, i.e., one of the remaining inputs to the AND gate AND1 is the engine signal of "H" level upon connection of the movable contact 117*d* of the charge relay 117 to the normally open contact terminal 117*b*. When the third input as a signal of "H" level from the water temperature discriminator 105 is supplied to the AND gate AND1, the timer signal of "H" level output from the after glow timer 108 is gated through the AND gate AND1. That is, when the cooling water temperature is discriminated to be 60° C. or less in the water temperature discriminator 105, the timer signal of "H" level output from the after glow timer 108 is gated through the AND gate AND1 (time e in FIG. 9E) and is then input to the OR gate OR2. In other words, after the ST position detection signal of "H" level is disabled, the timer signal of "H" level output from the after glow timer 108 is gated through the OR gate OR2. The PWM-modulated signal through the OR gate OR1 is intermittently gated through the AND gate AND3 in accordance with the timer signal of "H" level gated through the OR gate OR2. The PWM-modulated signal through the inverter INV controls the ON/OFF operation of the transistor Tr2. When the timer time T3 of the after glow timer 108 has elapsed, the timer signal of "H" level which is gated through the AND gate AND1 is disabled (time f in FIG. 9E). The PWM-modulated signal through the OR gate OR1 is blocked. ON/OFF driving of the transistor Tr2 through the inverter INV is interrupted (time f in FIG. 9H), and supply of a low power to the glow plug 103 is interrupted. Thereafter, the temperature of the glow plug 103 is rapidly decreased from the stable state (time f in FIG. 9I).

Figures 10A, 10B, 10C, 10D, 10E, 10F, 10G, 10H, 10I:
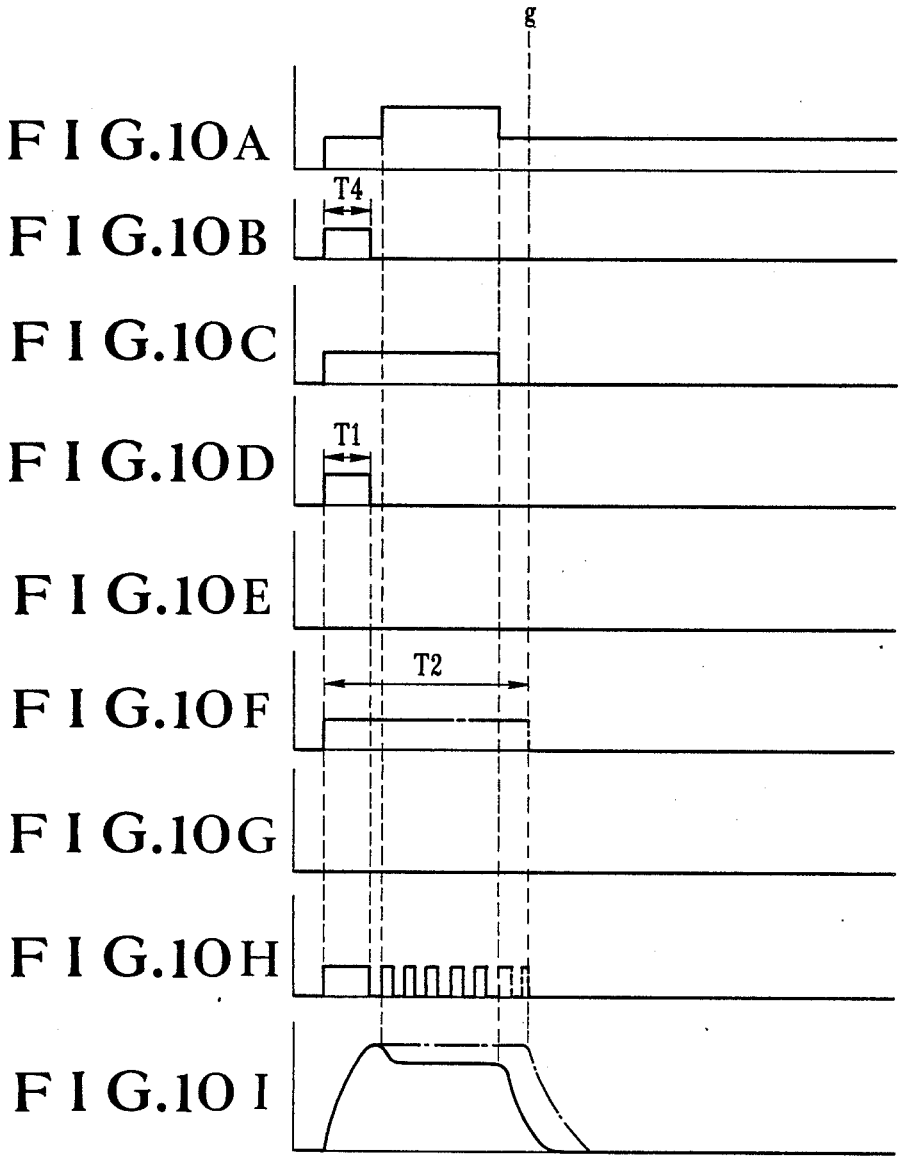
FIGS. 10A to 10I are timing charts for explaining the basic operation when a discrimination result of a cooling water temperature in the energization control apparatus in FIG. 8 represents 60° C. or more.

When the after glow timer 108 starts generating the timer signal of "H" level and if a discrimination result of the water temperature discriminator 105 represents 60° C. or higher, the timer signal of "H" level output from the after glow timer 108 cannot be gated through the AND gate AND1. Supply of power to the glow plug 103 is interrupted at this time (timing charts in FIG. 10A to 10I). At the start of operation, when the movable contact **102*d* of the key switch 102 is kept connected to the ON terminal 102*a*, that is, if the movable contact 102*d* is not connected to the starter terminal 102*b* although the indicator lamp 119 is turned off, the timer signal of "H" level is kept output from the ON state timer 109 during the time T2. When this timer signal is disabled (time g in FIG. 9F and time g in FIG. 10F), ON/OFF driving of the transistor Tr2 through the inverter INV is interrupted, and supply of the power to the glow plug 103** is interrupted.

Figure 11:
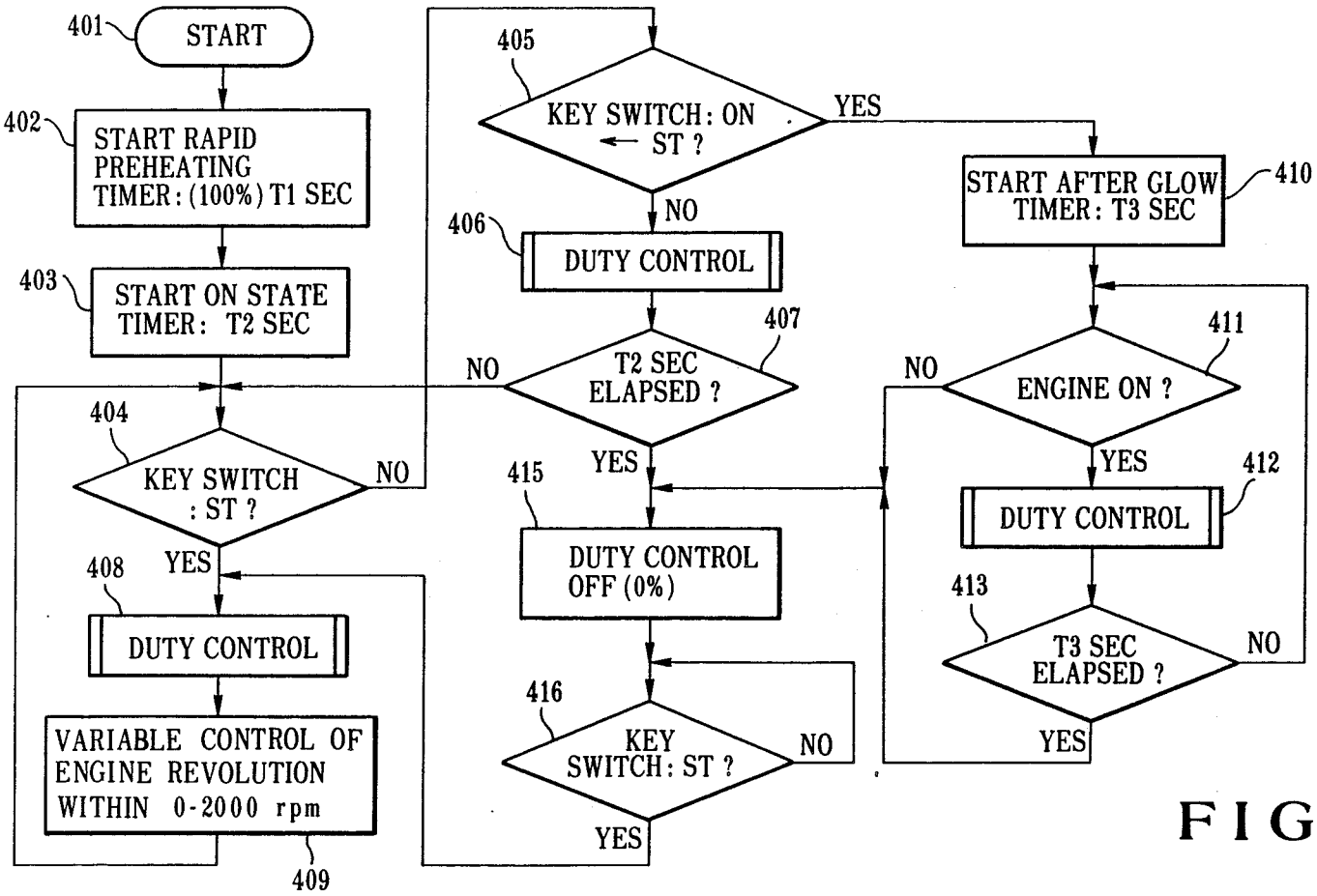
FIG. 11 is a flow chart for explaining an operation unique to the energization control apparatus shown in FIG. 8.

An operation unique to the energization control apparatus which performs the above basic operations will be described with reference to a flow chart in FIG. 11.

When the key switch 102 is operated to connect the movable contact **102*d* to the ON terminal 102*a* (step 401), counting of the rapid preheating timer 107 and the ON state timer 109 is started (steps 402 and 403). It is determined in step 404 whether the movable contact 102*d* of the key switch 102 is set at a position of connection with the starter terminal 102*b* (this position is referred to as a starter mode position). If NO in step 404, that is, if the movable contact 102*d* of the key switch 102 is set at a position of connection with the ON terminal 102*a* (this position is referred to as an ON mode position), it is determined in step 405 whether the ON mode position of the key switch 102 is set after the switch is set at the starter mode position. If NO in step 405, a lapse of the timer time T1 in step 402 is awaited. In step 406, duty control of the intermittent time of voltage applied to the glow plug 103** is performed.

Figure 12:
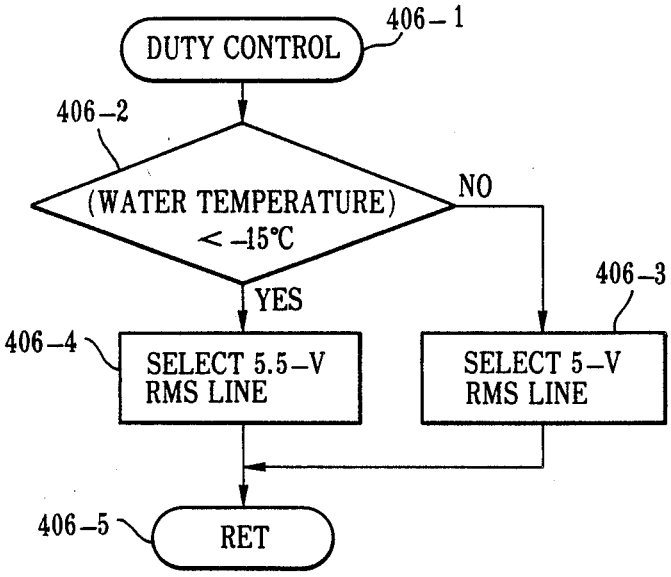
FIG. 12 is a flow chart showing a duty control subroutine.
Figure 13:
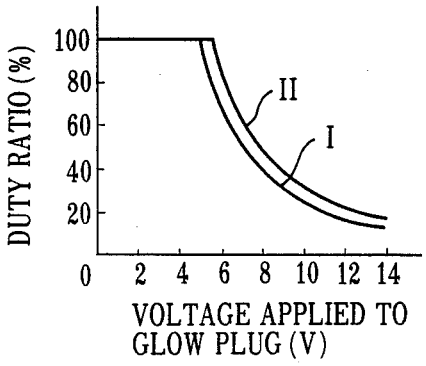
FIG. 13 is a graph showing a relationship between glow voltage (i.e., a voltage applied to the glow plug) monitored by a voltage detector in the energization control apparatus and the duty ratio of a PWM-modulated signal.

FIG. 12 is an interrupt subroutine in step 406. It is determined in step 406-2 whether a cooling water temperature is discriminated to be −15° C. or less by the water temperature detector 105. If NO in step 406-2, the engine is determined not to be exposed in a severe wintertime condition, and step 406-3 is executed. More specifically, the reference level of the triangular wave voltage signal from the triangular wave generator 114 is set to be a lower level. The triangular wave voltage signal and the reference voltage from the reference voltage generator 113 are compared by the comparator 116. A PWM-modulated signal as a comparison output from the comparator 116 controls ON/OFF driving of the transistor Tr2. That is, when the reference voltage set by the reference voltage generator 113 is increased in proportion to an increase in voltage applied to the glow plug. A duty ratio of the PWM-modulated signal output from the comparator 116 is decreased in proportion to an increase in voltage applied to the glow plug. FIG. 13 shows a relationship between the voltage applied to the glow plug and modified by the voltage detector 111 and the duty ratio of the PWM-modulated signal output from the comparator 116. Upon execution of step 406-3, an RMS value of the voltage applied to the glow plug 103 is maintained to be 5 V regardless of changes in voltage applied to the glow plug, on the basis of a characteristic curve I (FIG. 13) representing the relationship between the duty ratio and the voltage applied to the glow plug.

However, if it is determined in step 406-2 that the discrimination result of the water temperature discriminator 105 represents −15° C. or less, the engine is discriminated to be exposed in the severe wintertime condition, and step 406-4 is executed. That is, the reference level of the triangular wave voltage signal from the triangular wave generator 114 is set to be a higher level, and an offset value of the characteristics representing the relationship between the duty ratio of the PWM-modulated signal output from the comparator 116 and the voltage applied to the glow plug is increased. That is, upon execution of step 406-4, a characteristic curve II (FIG. 13) representing the relationship between the duty ratio and the voltage applied to the glow plug and having a higher offset value than that of the characteristic curve I is used. An RMS value of the voltage applied to the glow plug 3 is maintained to be 5.5 V in accordance with the characteristic curve II regardless of changes in voltage applied to the glow plug.

Figure 14:
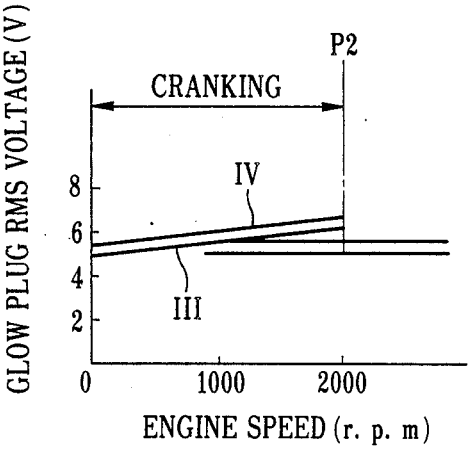
FIG. 14 is a graph showing the relationship between the engine speed and the RMS values of the voltages applied to the glow plug.

Duty control of the intermittent time of the voltage applied to the glow plug 103 in step 406 is repeated until the timer time T2 of the ON state timer 109 has elapsed in step 407. When the key switch 102 is switched to the starter mode position in step 404 before a lapse of the timer time T2, the same duty control subroutine as in step 406 is performed in step 408. In addition, in step 409, variable control is performed to set the RMS value of the voltage applied to the glow plug 103 to be proportional to the engine speed. More specifically, the F/V conversion signal corresponding to the engine speed is input from the F/V converter 112 to the reference voltage generator 113. The reference voltage value set in the comparator 116 through the reference voltage generator 113 is decreased in proportion to the engine speed. If the engine speed is increased upon cranking, the duty ratio of the PWM-modulated signal output from the comparator 116 in proportion to the engine speed is increased. Therefore, the RMS value of the voltage applied to the glow plug 103 is increased. In this embodiment, an increase in RMS voltage falls within the range of 0 to 0.5 V with respect to the engine speed of 0 to 2,000 rpm. When the engine is not exposed in the severe wintertime condition, the RMS of the voltage applied to the glow plug 103 is kept at 5 V with respect to an engine speed of 0 rpm, as indicated by a characteristic curve III in FIG. 14. The RMS value is increased in proportion to an increase in engine speed. When the engine speed reaches 2,000 rpm, the RMS value of the voltage applied to the glow plug 103 reaches 5.5 V. However, when the engine is exposed in the severe wintertime condition, the RMS value of the voltage applied to the glow plug 103 is maintained at 5.5 V when the engine speed is 0 rpm. This RMS voltage value is then increased in proportion to an increase in engine speed. The RMS value of the voltage applied to the glow plug 103 reaches 6 V when the engine speed reaches 2,000 rpm.

Upon completion of the cranking operation, when the key switch 102 is returned to the ON mode position, it is determined in step 404 that the key switch 102 is not set at the starter mode position. It is then determined in step 405 that the key switch 102 is set to the ON mode position after the key switch 102 is set to the starter mode position. In step 410, the after glow timer 108 is started. It is then determined in step 411 whether the engine is rotated. If YES and a discrimination result which represents a cooling water temperature of 60° C. or less is obtained, the same duty control subroutine as in step 406 is performed in step 412. In this case, the ST position detection signal input from the ST position detector 110 to the F/V converter 112 is switched from "H" level to the "L" level upon switching of the key switch 102 to the ON mode position. The F/V conversion signal is not input from the F/V converter 112 to the reference voltage generator 113, and variable control of the RMS value of the voltage applied to the glow plug 103 in proportion to the engine speed is not performed. That is, when cranking is completed at time P2 in FIG. 14, duty control of the intermittent time of the voltage applied to the glow plug 103 on the basis of the characteristic curve I or II shown in FIG. 13 is performed for the engine speed during stable heating after time P2 in accordance with a given condition. Duty control of the voltage applied to the glow plug 103 in step 412 is repeated until the timer time T3 of the after glow timer 108 has elapsed in step 413.

When the time T2 has elapsed in step 407 but engine rotation is not confirmed in step 411, the flow advances to step 415 upon a lapse of the timer time T3 of the after glow timer 108. ON/OFF control of the transistor Tr1 in step 415 is interrupted, and supply of the power to the glow plug 103 is interrupted. In the next step 416, switching of the key switch 102 to the starter mode position is prepared. That is, when an engine stop occurs even after a lapse of the timer time T3 of the after glow timer 108, the key switch 102 is set to the starter mode position again, thereby performing duty control of the glow plug 103 in step 408.

In the energization control apparatus for a glow plug according to this embodiment described above, the RMS value of the voltage applied to the glow plug is increased in proportion to the engine speed. An increase in RMS voltage value can compensate for a decrease in temperature of the glow plug during cranking. That is, fuel spray swirl generated in the combustion chamber during cranking is increased with an increase in engine speed. In other words, the decrease in temperature of the glow plug is almost proportional to the engine speed. If the RMS value of the voltage applied to the glow plug is increased, the decrease in temperature of the glow plug which is caused by the fuel spray swirl can be corrected, thereby preventing degradation of the starting characteristics of the engine. In addition, according to this embodiment, when the engine is exposed in a severe wintertime condition wherein a cooling water temperature is −15° C. or less, the RMS of the voltage applied to the glow plug can be increased from the normal RMS value. The temperature of the glow plug can be relatively increased, and degradation of the starting characteristics of the engine can be prevented. In particular, this effect can be maximized during cranking. In addition to an increase in RMS value of the voltage in proportion to an increase in engine speed, the starting characteristics of the engine can be greatly improved as compared with a conventional case.

In this embodiment, the decrease in temperature of the glow plug which is caused by fuel spray swirl during cranking is detected on the basis of the engine speed which is almost proportional to this decrease in temperature. A proportional function for detecting a decrease in temperature of the glow plug is not limited to the engine speed. For example, a glow plug having a large resistance/temperature coefficient may be used. In this case, a current supplied through this glow plug is detected, and a temperature decrease may be detected by a detected current. In this embodiment, when the engine is exposed in a wintertime condition, the RMS value of the voltage applied to the glow plug is larger than the normal operation value throughout the range of stable heating. However, this may be limited to only cranking. In this manner, when the RMS value of the voltage is increased during only cranking, the service life of the glow plug can be prolonged.

In this embodiment, the RMS value of the voltage applied to the glow plug in proportion to the engine speed is increased during cranking, and at the same time, the RMS value of the voltage applied to the glow plug is increased for an engine in a severe wintertime condition. However, these operations may be independently performed.

In the above embodiment, the low power during stable heating of the glow plug is obtained by duty-controlling the intermittent time of the voltage applied thereto. However, duty control for supplying power to the glow plug is not limited to the above duty control technique.

In the energization control apparatus for a glow plug according to the present invention as has been described above, the low power supplied to the glow plug during stable heating and maintained to be almost a constant value upon monitoring of the voltage applied to the glow plug is increased on the basis of a proportional function which is changed in almost proportional to a decrease in temperature of the glow plug. Therefore, the decrease in temperature of the glow plug cooled by the fuel spray swirl generated in the combustion chamber can be compensated, and degradation of the starting characteristics of the engine can be prevented.

The low power supplied to the glow plug during stable heating and maintained to be almost a constant value upon monitoring of the voltage applied to the glow plug is increased by detecting a severe wintertime condition having a temperature lower than a predetermined temperature. The temperature of the glow plug in the severe wintertime condition can be relatively increased, and degradation of the starting characteristics of the engine can be prevented.

Figure 15:
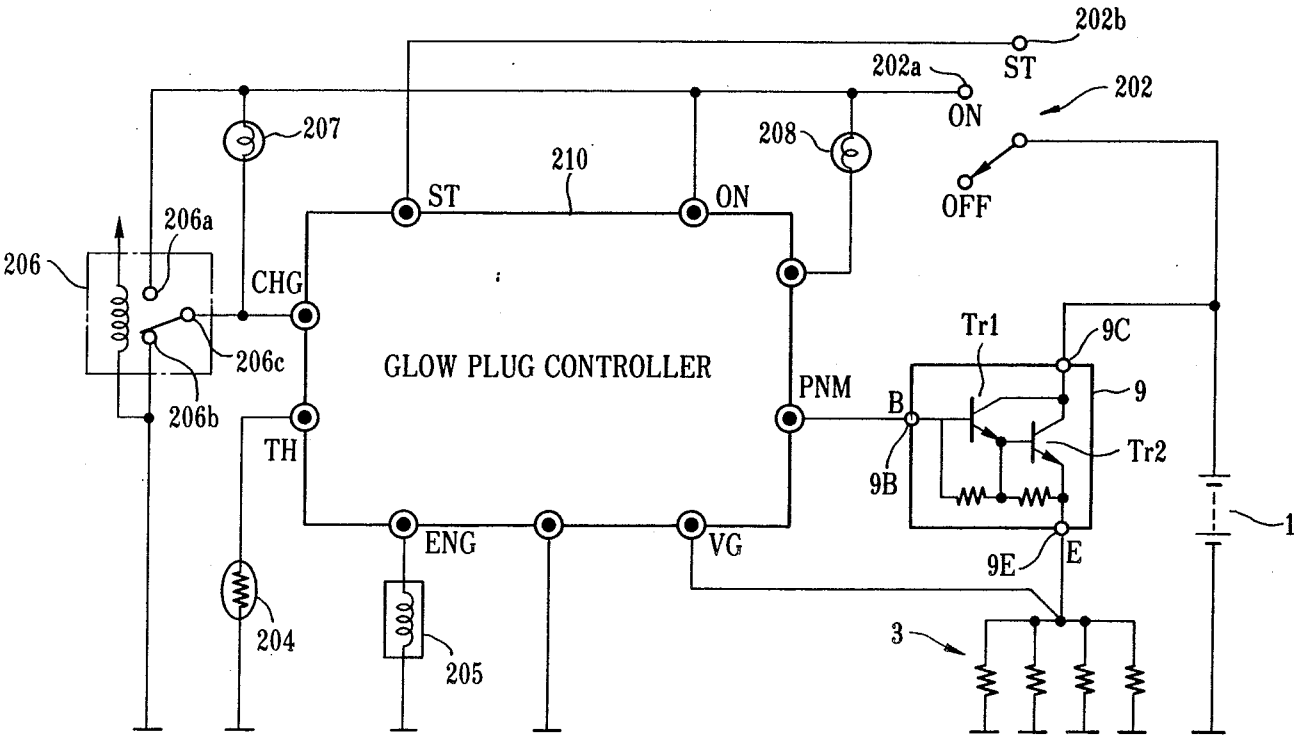
FIG. 15 is a block diagram showing an energization control apparatus for a glow plug which employs a method of controlling energization of the glow plug according to still another embodiment of the present invention.

FIG. 15 shows still another embodiment of the present invention.

Referring to FIG. 15, reference numeral 201 denotes a battery; 202, a key switch; 203, a glow plug partially extending into each combustion chamber (not shown) of a cylinder head of a diesel engine (to be referred to as an engine hereinafter); 204, a water temperature sensor for detecting a cooling water temperature of the engine; 205, a pickup for detecting an engine speed; 206, a charge relay whose normally open contact terminal **206*a* is closed during engine rotation and whose common terminal 206*c* generates an engine signal of "H" level during engine rotation; 207, a charge lamp; 208, an indicator lamp; 209, a power controller to the power source line of the glow plug 203; and 210**, a glow plug controller.

The glow plug controller 210 receives voltage signals appearing at an ON terminal 202*a* and an ST terminal 202*b* of the key switch 202, an RMS voltage (glow voltage) VG applied to the glow plug 203, a cooling water temperature signal output from the water temperature sensor 204, an engine speed signal output from the pickup 205, and an engine signal appearing at the common terminal 206*c* of the charge relay 206. A pulse-width modulated signal (PWM-modulated signal) for controlling ON/OFF time of the power controller 209 on the basis of the input signals is applied to a base terminal 9B of the power controller 209 consisting of Darlington-connected npn transistors Tr1 and Tr2. The glow plug 203 is a high-performance glow plug which can be rapidly heated to a sufficient temperature (e.g., 800° C.) at a voltage (e.g., 9 V) lower than a rated voltage (12 V) of the battery 201.

FIGS. 17A to 17D are timing charts showing energization control states of the glow plug 203 by the glow plug controller 210 in a temperature range of $-15°$ C.$<t<+60°$ C. (normal atmospheric range) when the outer air temperature is defined as t. Assume that the outer air temperatures fall within the range of $-15°$ C.$<t<+60°$ C. in the glow plug controller 210 on the basis of the cooling water whose temperature is detected by the water temperature sensor 204. When the movable contact of the key switch 202 is connected to the ON terminal 202*a* (connection to the ON mode position) and at the same time the power controller 209 is driven at a 100% duty ratio on the basis of the PWM-modulated signal from the controller 210 (time a in FIG. 17A). A maximum glow voltage VG1 determined by the battery voltage value at the 100% duty ratio is applied from the power controller 209 to the glow plug 203 (time a in FIG. 17B). The glow plug 203 is rapidly heated (time a in FIG. 17D). At time b in FIG. 17A, the connection of the key switch 202 to the ST terminal 202*b* (connection to the ST mode position) is performed (time b in FIG. 17A), and then cranking of the engine is started (time b in FIG. 17C). When a predetermined period of time required for increasing the temperature of the glow plug 203 to about 800° C. has elapsed, the voltage VG1 applied to the glow plug 203 is decreased to a voltage VG2 on the basis of the PWM-modulated signal from the glow plug controller 210 (time c in FIG. 17B). The glow plug 203 enters a stable heating range in accordance with the voltage VG2 applied thereto. Upon the first ignition, the cranking speed is increased and reaches 500 rpm (time d in FIG. 17C). In this case, at the start of fuel injection during cranking, the temperature of the glow plug 203 almost reaches the last period of temperature rise and is a considerably high temperature. The viscosity of fuel and spray particle size are not degraded in the normal atmospheric range, and no degradation such as degradation of ignition occurs.

In the severe wintertime condition wherein the outer air temperature t is $-15°$ C. or less, if the key switch 202 is set to the ON mode position, and at the same time the glow plug 203 is subjected to rapid heating, the fuel viscosity at the start of fuel injection during cranking is increased and the spray particle size is also increased. However, since the temperature of the glow plug 203 reaches the above-mentioned high temperature, degradation of ignition does occurs.

FIGS. 16A to 16D are timing charts showing energization control states of the glow plug 203 in the severe wintertime condition wherein $t<-15°$ C. More specifically, the glow plug controller 210 detects a severe wintertime condition on the basis of a cooling water temperature detected by the water temperature sensor 204. Even if the key switch 202 is set at the ON mode position at time a in FIG. 16A, the glow voltage VG1 is not applied to the glow plug 203. When the key switch 202 is set at the ST (starter) mode position at time b in FIG. 16A, the glow voltage VG1 is supplied to the glow plug 203 (time b in FIG. 16B). Upon supply of the glow voltage VG1, the glow plug 203 is rapidly heated (time b in FIG. 16D). At the same time, cranking of the engine is started (time b in FIG. 16C). The glow voltage VG1 applied to the glow plug 203 is decreased to the voltage VG2 on the basis of the PWM-modulated signal from the glow plug controller 210 when a predetermined period of time has elapsed (a lapse of 1.5 sec in this embodiment) (time c in FIG. 16B). The glow plug 203 enters the stable heating range in accordance with the glow voltage VG2. Upon the first ignition, the cranking speed is increased and reaches 500 rpm (time d in FIG. 16C). In this case, at the start of fuel injection during cranking, the temperature of the glow plug 203 is kept at a low temperature in the initial period of temperature rise. Even if problems are presented by the viscosity of fuel and spray particle size, ignition is not degraded.

In FIGS. 16A to 16D and FIGS. 17A to 17D, the glow plug controller 210 controls to detect an increase in cranking speed of 500 rpm or more. When the cranking speed exceeds 500 rpm, the glow voltage VG2 in the stable heating range is increased to a voltage VG3. Supply of the glow voltage VG3 to the glow plug 203 continues until the engine speed reaches 2,000 rpm (time e in FIGS. 16C and 17C). When the engine speed reaches 2,000 rpm, perfect ignition is discriminated to be ensured, and stable heating with the voltage VG2 is restored. Until the engine speed reaches 2,000 rpm after it reaches 500 rpm, the low power supplied to the glow plug 203 during stable heating is increased. Until perfect ignition is achieved after the engine speed reaches 500 rpm, a target temperature during stable heating of the glow plug 203 is set to be slightly higher than the normal temperature during stable heating. The perfect combustion time from the first ignition to perfect ignition can be shortened by a combination of the increase in target temperature and the nature of the engine. In particular, in the severe wintertime range shown in FIGS. 16A to 16D, an effect for shortening the perfect combustion time can be maximized.

When the cooling water temperature reaches 60° C., supply of the glow voltage VG2 to the glow plug 203 is interrupted (time f in FIGS. 16B and 17B). Referring to FIG. 17A, when the key switch 202 is not set to the ST mode position after being set to the ON mode position, supply of the glow voltage VG2 to the glow plug 203 is forcibly interrupted at time g after a lapse of a predetermined period of time (about 5 sec in this embodiment), as indicated by the broken line in FIG. 17B. Referring to FIGS. 16A to 16D and 17A to 17D, the glow voltage VG2 for stable heating is not applied as the voltage VG3 to the glow plug from the beginning in order to prevent overheating of the glow plug 203 prior to the start of the engine.

FIGS. 18A to 18D are timing charts showing energization control states of the glow plug 203 under the control of the glow plug controller 210 after the vehicle travel in a state wherein a cooling water temperature exceeds +60° C. Even in this case, energization control similar to that in the severe wintertime condition is performed. However, in this case, stable heating after the engine speed reaches 2,000 rpm is not performed.

In FIGS. 16A to 16D and 18A to 18D, the glow plug 203 is powered when the key switch is set at the ST mode position. However, a low power may be supplied to the glow plug 203 from the moment of connection of the key switch to the ON mode position if this power is not a high power for rapid heating. According to experiments of the present inventor, if a glow plug temperature is 300° C. or less during fuel injection at the start of cranking, degradation of ignition in the severe wintertime condition can be prevented and the starting characteristics can be improved. The temperature range of the glow plug during fuel injection varies depending on characteristics of a glow plug used. In this embodiment, the glow voltage VG2 during stable heating is switched to the voltage VG3 (a timing for switching the voltage to a desired voltage) when the engine speed reaches 500 rpm. Perfect ignition is detected when the engine speed reaches 2,000 rpm. However, the power switching timing and the engine speeds for the detection references need not be defined by 500 rpm and 2,000 rpm. In addition, the engine speed need not serve as the detection reference. A battery voltage, a battery current, or a starter current may serve as a parameter corresponding to the engine speed.

According to this embodiment, supply of the high power to the glow plug is started from the start of cranking of the engine in a severe wintertime condition wherein an outer air temperature is lower than the predetermined temperature. At the time of fuel injection during cranking, the glow plug is not overheated. Even if some problems are presented by the fuel viscosity and spray particle size, ignition is not degraded, and the starting characteristics in the severe wintertime condition can be improved.

The switching timing of the desired power supply upon starting of cranking is detected, and the low power for stable heating is increased. If the switching timing of the power supply is optimally determined, a perfect combustion time from the first ignition to perfect ignition can be shortened. In particular, shortening of the perfect combustion time can provide a maximum effect in the severe wintertime condition.

What is claimed is:

1. An energization control apparatus for a glow plug, comprising:

a battery;

a glow plug having a low rated voltage which allows rapid heating at a low battery voltage during cranking of a diesel engine in a severe wintertime condition;

power control means, arranged between said battery and said glow plug, for controlling a power supplied to said glow plug; and energization control means for controlling said power control means so as to control a root-mean-square value of a voltage applied to said glow plug to be equal to the low rated voltage when a voltage applied to said glow plug at the start of the diesel engine is detected to be higher than the low battery voltage, wherein said energization control means controls a duty ratio for controlling an ON/OFF operation of said power control means, and said energization control means comprises:

first and second timers started in association with a key switch operation, said first timer setting a rapid heating time at an initial period of energization;

reference voltage setting means controlled in accordance with an output from said first timer;

battery voltage detecting means; and duty ratio control means for controlling the duty ratio for controlling the ON/OFF operation of said power control means, said first timer counting a time shorter than that of said second timer, said second timer setting an after glow time, and said reference voltage setting means changing the reference voltage by an ON/OFF operation of said first timer.

2. An apparatus according to claim 1, further comprising water temperature detecting means for detecting a temperature of cooling water of the diesel engine, and wherein said second timer changes a counting time by the temperature of cooling water detected by said water temperature detecting means.

3. An apparatus according to claim 1, further comprising means for terminating or interrupting the counting operation when the engine is not started after a lapse of a predetermined period of time upon an ON operation of a key switch.

4. An energization control apparatus for a glow plug, comprising:

a battery;

a glow plug having a low rated voltage which allows rapid heating at a low battery voltage during cranking of a diesel engine in a severe wintertime condition;

power control means, arranged between said battery and said glow plug, for controlling a power supplied to said glow plug;

energization control means for controlling said power control means so as to control a root-mean-square value of a voltage applied to said glow plug to be equal to the low rated voltage when a voltage applied to said glow plug at the start of the diesel engine is detected to be higher than the low battery voltage, said energization control means controlling a duty ratio for controlling an ON/OFF operation of said power control means; and means for detecting an element associated with a change in temperature of said glow plug, and wherein said energization control means comprises means for controlling the power supplied to said glow plug by controlling said power control means on the basis of a detected change in element during cranking of the diesel engine, wherein the element is a diesel engine speed, and said control means increases the power supplied to said glow plug in accordance with an increase in diesel engine speed.

5. An apparatus according to claim 4, wherein said control means controls the power supplied to said glow plug by increasing the duty ratio for controlling the ON/OFF operation of said power control means.

6. An apparatus according to claim 4, further comprising means for detecting an element associated with a change in temperature of said glow plug, and wherein said energization control means comprises means for increasing the power supplied to said glow plug by controlling said power control means when the severe wintertime condition is detected by a change in element.

7. An apparatus according to claim 6, wherein the element is a temperature of cooling water of the diesel engine, and said control means increases the power supplied to said glow plug in association with a decrease in temperature of the cooling water.

8. An apparatus according the claim 4, further comprising means for detecting an element associated with a change in temperature of said glow plug, and wherein said energization control means supplies a high power commencing with the start of cranking of the diesel engine by controlling said power control means when the severe wintertime condition is detected by a change in element.

9. An apparatus according to claim 8, wherein said energization control means increases a low power for stable heating as compared with a normal low power for stable heating from a predetermined timing during cranking.

* * * * *

UNITED STATES PATENT AND TRADEMARK OFFICE

CERTIFICATE OF CORRECTION

PATENT NO. : 4,939,347

DATED : 7/3/90

INVENTOR(S) : Masaka et al.

It is certified that error appears in the above-identified patent and that said Letters Patent is hereby corrected as shown below:

| | | |
|---|---|---|
| col. 17, line 01 | after "controller" | insert --connected-- |

Signed and Sealed this

Eighteenth Day of May, 1993

*Attest:*

Michael K. Kirk

MICHAEL K. KIRK

*Attesting Officer*

*Acting Commissioner of Patents and Trademarks*